United States Patent [19]

Holmes

[11] 4,276,943

[45] Jul. 7, 1981

[54] FLUIDIC PULSER

[75] Inventor: Allen B. Holmes, Rockville, Md.

[73] Assignee: The United States of America as represented by the Secretary of the Army, Washington, D.C.

[21] Appl. No.: 78,748

[22] Filed: Sep. 25, 1979

[51] Int. Cl.[3] ..... E21B 47/12; F15C 1/16

[52] U.S. Cl. ..... 175/40; 137/810; 137/812; 175/45; 175/48; 175/50; 340/861; 367/83

[58] Field of Search ..... 137/808, 810, 812, 813, 137/811, 839; 175/40, 48, 50, 45; 367/82, 83; 116/137 R; 340/861

[56] References Cited

U.S. PATENT DOCUMENTS

| | | | |
|---|---|---|---|
| 3,209,774 | 10/1965 | Manion . | |
| 3,238,960 | 3/1966 | Hatch, Jr. | 137/811 |
| 3,244,370 | 4/1966 | Colston | 137/811 X |
| 3,302,457 | 2/1967 | Mayes | 367/83 X |
| 3,373,759 | 3/1968 | Adams | 137/810 |
| 3,511,255 | 5/1970 | Bauer | 137/811 X |
| 3,534,756 | 10/1970 | Swartz . | |
| 3,739,979 | 6/1973 | Hanada et al. . | |
| 3,958,217 | 5/1976 | Spinnler | 367/83 |
| 3,964,556 | 6/1976 | Gearhart et al. | 367/83 X |
| 4,000,757 | 1/1977 | Freeman | 137/839 X |

FOREIGN PATENT DOCUMENTS

| | | | |
|---|---|---|---|
| 1385740 | 2/1975 | United Kingdom | 137/808 |

*Primary Examiner*—Stephen J. Novosad

*Attorney, Agent, or Firm*—Nathan Edelberg; Robert P. Gibson

[57] ABSTRACT

A fluid telemetry system is disclosed which utilizes an improved pulsing device. The pulser comprises a bistable fluid amplifier. Both outlets of the bistable fluid amplifier communicate tangentially with a vortex chamber. A pulse in the fluid entering the amplifier may be produced each time the fluid flow is diverted from one outlet to the other.

8 Claims, 11 Drawing Figures

REDUCED FLOW

INCREASED FLOW

REDUCED FLOW

REDUCED FLOW

INCREASED FLOW

REDUCED FLOW

FLUIDIC PULSER

RIGHTS OF THE GOVERNMENT

The invention described herein may be manufactured, used, and licensed by or for the United States Government for governmental purposes without the payment to me of any royalty thereon.

BACKGROUND OF THE INVENTION

The invention relates to systems for transmitting information from the bottom of a bore hole in the earth to the surface by way of pressure pulses created in a circulating mud stream in a drill string. More particularly, this invention relates to an apparatus for changing the resistance to the flow of the mud stream in the drill string to create pressure pulses therein.

The usefulness of obtaining data from the bottom of an oil, gas or geothermal well during drilling operations without interrupting these operations has been recognized for many years. However, no proven technology reliably provides this capability. Such a capability would have numerous benefits in providing for safer and less costly drilling of both exploration and production wells.

Any system that provides measurements while drilling (MWD) must have three basic capabilities: (1) to measure the down hole parameters of interest; (2) to telemeter the resulting data to a surface receiver; and (3) to receive and interpret the telemetered data.

Of these three essential capabilities, the ability to telemeter data to the surface is currently the limiting factor in the development of an MWD system.

For reasons of economy and safety it is highly desirable that the operator of a drill string be continually aware of such down hole parameters as drill bit position, temperature and bore hole pressure. Knowledge of the drill bit position during drilling would save significant time and expense during directional drilling operations. For safety it is of interest to predict the approach of high pressure zones to allow the execution of proper preventative procedures in order to avoid blowouts. In addition proper operation of the drill string requires continuous monitoring of down hole pressure. The pressure in the bore hole must be maintained high enough to keep the walls of the hole from collapsing on the drill string yet low enough to prevent fracturing of the formation around the bore hole. In addition the pressure at the bit must be sufficient to prevent the influx of gas or fluids when high pressure formations are entered by the drill bit. Failure to maintain the proper down hole pressure can and frequently does lead to loss of well control and blowouts.

Four general methods are being studied that would provide transmission of precise data from one end of the well bore to the other: mud pressure pulse, hard wire, electromagnetic waves, and acoustic methods. At this time, the mud pressure pulse method seems to be the closest to becoming commercially available.

In a typical mud pulsing system pressure pulses are produced by a mechanical valve located in a collar above the drill bit. The pulses represent coded information from down hole instrumentation. The pulses are transmitted through the mud to pressure transducers at the surface, decoded and displayed as data representing pressure, temperature, etc. from the down hole sensors. Of the four general methods named above mud pulse sensing is considered to be the most practical as it is the simplest to implement and requires no modification of existing drill pipe or equipment.

Mechanical mud pulsers known in the art are inherently slow, producing only one to five pulses per second, are subject to frequent mechanical breakdown, and are relatively expensive to manufacture and maintain. An example of such a device is U.S. Pat. No. 3,958,217 which shows a valve mechanism for producing mud pulses.

U.S. Patent Application Ser. No. 74,636 discloses a mud pulse telemetry system which is an improvement over the previously known mechanical systems which utilize valve mechanisms. The improved system uses a pulser which comprises a bistable fluid amplifier and a vortex chamber. One outlet of the amplifier enters the vortex chamber radially, while the other outlet enters the vortex chamber tangentially. Such an arrangement is capable of producing a pressure pulse in the fluid flowing through the amplifier for each full cycle of oscillation of the fluid flow between the respective outputs of the amplifier.

SUMMARY OF THE INVENTION

The present invention represents a substantial improvement over the prior art mud pulsing mechanisms which utilize valves to generate pulses in the mud flow. The device of the present invention is also an improvement over that of application Ser. No. 74,636, in that it is capable of generating a higher pulse frequency in the mud flow.

Accordingly, it is an object of this invention to provide a mud pulse transmitter having a very high data transmission rate.

It is another object of the invention to provide a mud pulse transmitter having no moving parts to jam or wear out, and no mechanical seals to cause leaks.

A further object of the invention is to provide a mud pulse transmitter which is inexpensive to fabricate as well as to maintain.

It is still another object of the invention to provide a mud pulse transmitter which can be easily adapted for use with standard well logging instrumentation and can be easily installed in conventional drill collars.

Yet another object of the invention is to provide a mud pulse transmitter which drains very little power from the drill string apparatus.

DESCRIPTION OF THE PREFERRED EMBODIMENT

Figure 1:
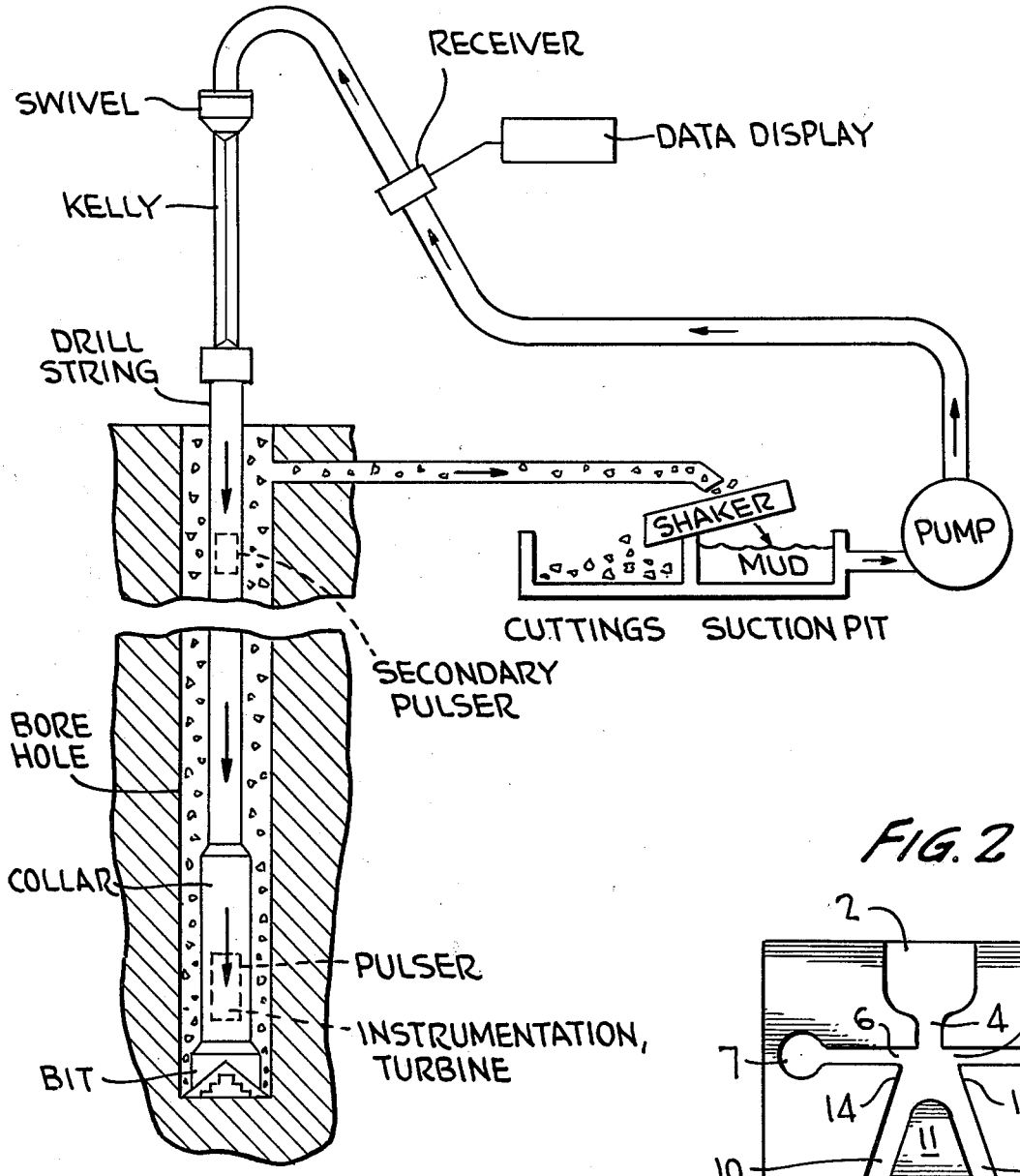
FIG. 1 is a schematic view showing the relationship between the elements of the telemetry system and the drill string.

Referring to FIG. 1, there is shown the general arrangement of a drill string comprising a telemetry system. As the drill string operates to continually increase the depth of the bore hole, a fluid, commonly called mud, is pumped down through the drill string past the drill bit to carry cuttings to the surface of the bore hole where they are then separated from the mud. The mud is then recirculated down through the drill string. Mounted generally down near the base of the drill string, adjacent to the drill bit, is an instrumentation package generally comprising transducers capable of sensing physical parameters in the bore hole.

The pulser is provided in the drill string generally adjacent to instrumentation for generating pulses in the fluid mud.

A pressure transducer, generally denoted as a receiver in FIG. 1, is provided for receiving the pulses in the mud at a location in the drill string generally above ground level. The data display or recording device is associated with the receiver.

In a complete mud pulse telemetry system, the pressure signals will be monitored at the surface by the pressure transducer. Electrical power to operate the pulser and downhole electronics will be supplied by a mud turbine driven generator, or battery as shown schematically in FIG. 1. Measurements made downhole will be digitized and fed to an actuator. The presence and absence of a signal will represent the binary numbers 0 or 1 as will the presence or absence of a pressure pulse at the surface. The received signals will be converted back into a usable data mode by the pressure transducer. The signals will be decoded and displayed as data.

Figure 2:
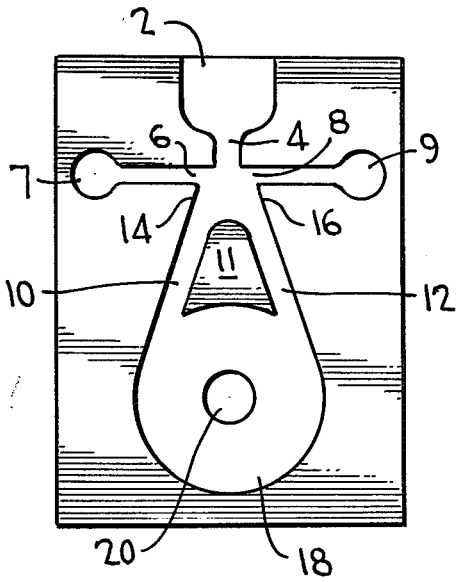
FIG. 2 is a detailed view showing the improved pulsing mechanism of the invention.

FIG. 2 shows in detail a pulser of the present invention. The pulser comprises an inlet 2 which directs fluid flow to power nozzle 4. Since the device operates essentially as a bistable fluid amplifier, fluid flow from nozzle 4 will assume a stable condition through either of outlets 10 or 12. Divider 11 separates the respective outlets. Control ports 6 and 8, communicating with control inlets 7 and 9, respectively, operate to deflect fluid flow from nozzle 4 to either of the outlet paths, as will described below. The outlets 10 and 12 communicate with a vortex chamber 18 in respectively opposite tangential directions. Vortex chamber 18 comprises an axial outlet 20 which allows fluid flow into the vortex chamber to drain from the chamber.

The pulser of FIG. 2 can be formed by any suitable method, such as milling or otherwise forming the various elements in a block of material and mating the block of material with a cover portion. The material from which the pulser is made may comprise metals or plastics or any suitable material depending on the environment in which the pulser is to be used.

Figure 3A:
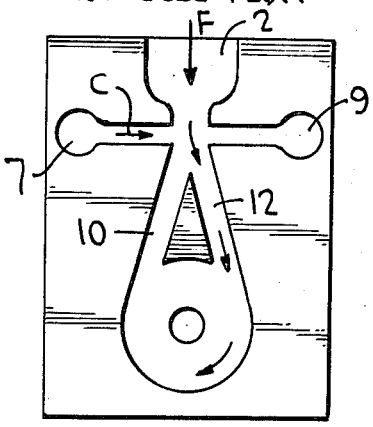
FIGS. 3A, 3B, and 3C illustrate the manner in which the pulsing mechanism produces pulses in the mud flow.

In operation, the pulser is mounted in the drill string near the bottom thereof, as illustrated in FIG. 1, to receive all or a portion of the mud flow. Fluid entering inlet 2, as shown by arrows F in FIG. 3A, will assume a stable flow condition through one of the outlets, for example outlet 12 as shown in FIG. 3A. Such flow through outlet 12 will generate a clockwise vortex in the vortex chamber 18. The stable flow condition is a result of the fluid flow through the inlet attaching itself to the wall of the outlet path in the region of wall portion 16 as shown in FIG. 2, as is well known in the prior art. In the absence of a control signal the flow will remain in this condition.

If a control pressure pulse is provided through control inlet 9 and control port 8, a pressure buildup will occur in the region of wall portion 16, and the fluid flow will be diverted in the direction of outlet path 10. Once the fluid flow is fully diverted, the flow will assume stable condition through outlet path 10 by attaching to the wall of the outlet in the region of wall element 14. Such a flow will produce a counterclockwise vortex in chamber 18, as shown in FIG. 3C.

Figure 3B:
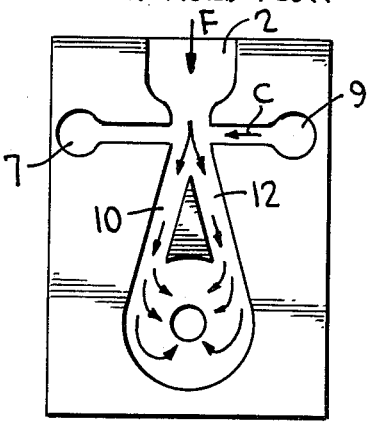
Figure 3C:
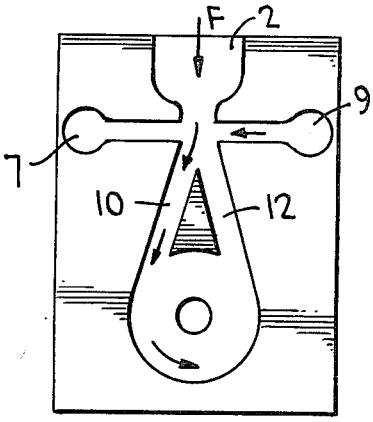

During the period of time that the flow is being diverted between paths 12 and 10, flow through nozzle 4 will be directed into both outlets 10 and 12, producing a substantially balanced flow into the chamber 18, as shown in FIG. 3B. Flow of this nature will be generate a vortex in the chamber 18, but will create a substantially radial flow into the outlet 20.

It is to be understood that a similar control pressure pulse through control path 7 and control port 6 will operate to deflect fluid flow back toward the outlet port 12, in the manner described above.

Resistance to flow of fluid through the outlet sink 20 of vortex chamber 18, is proportional to the vortical velocity of the fluid in the chamber. As the vortical velocity increases, the resistance to flow through the vortex chamber also increases. If the flow in the chamber is substantially radial, as shown in FIG. 3B, resistance to flow through the vortex chamber will be substantially reduced. As the reversal in vortical direction takes place, as illustrated in FIGS. 3A–3C, the tangential velocity of the vortical flow goes from a maximum value in a given direction through zero to some maximum value in the opposite direction. This will act to vary the flow rate through the vortical chamber, and thus vary the flow rate through the fluid amplifier. The fluid flow rate will be minimized when the vortical velocity is greatest, and maximized when the radial components of flow are predominant. Because of this variable flow capability, the vortex chamber is also commonly known as a vortex value.

The change in the velocity of flow through inlet 2 which is associated with the change in flow velocity through the vortical chamber produces a pressure wave in the fluid flowing through the drill string, commonly referred to as water hammer. The pressure waves propagate back through the drill string to the receiver, as illustrated in FIG. 1. The amplitude of the wave is primarily a function of mud density and the change in velocity caused by the change in flow. The duration of the wave is dependent on pulser response.

Figure 4A:
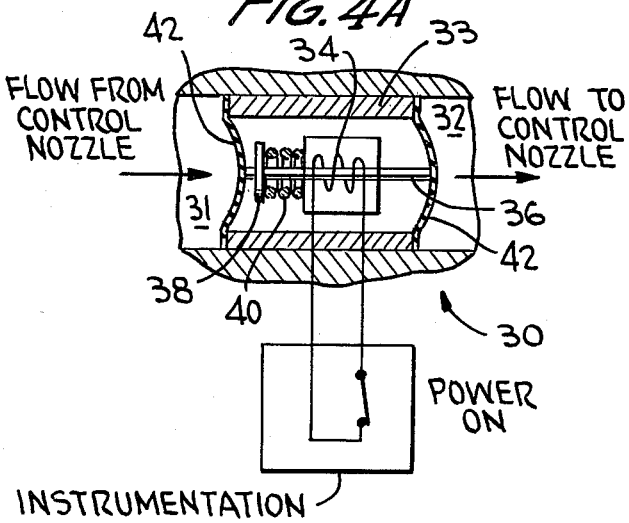
FIGS. 4A and 4B illustrate a suitable embodiment of an actuator mechanism for the apparatus of the present invention.
Figure 4B:
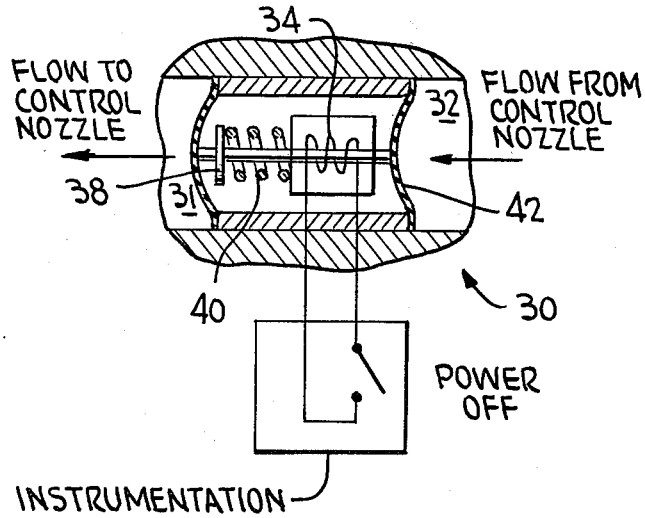

FIGS. 4A and 4B illustrate an embodiment of an actuator mechanism suitable for use with the pulser of the present invention. The figures show an instrumentation package which corresponds generally to that shown in FIG. 1. The package comprises transducers which are capable of measuring down hole physical parameters, such as temperature, pressure, orientation of the drill bit, etc. The actuator itself, 30, is mounted in control passages 31, 32 by suitable securing means 33. The mechanism comprises a solenoid col 34, armature 36, means 38 mounted on the armature, and spring means 40, bearing on the abutment 38. Flexible diaphragm means 42 are secured to retaining means 33 and to armature 36. Movement of the armature 36 will control movement of the diaphragms 42.

When the instrumentation provides a power signal to coil 34 as shown in FIG. 4A, the coil will be energized causing armature 36 to move to the right, compressing spring element 40, and creating a positive pressure pulse in control channel 32. The pressure pulse will propagate through suitable connecting conduits to control inlet 9, as shown in FIG. 2, thus generating a pressure pulse at control port 8. When the power signal from the instrumentation package is turned off, as shown in FIG. 4B, spring element 40 will expand, moving armature 36 back toward the left generating a positive pressure pulse in channel 31. This pressure pulse will propagate by means of suitable connecting conduits to control inlet 7, as shown in FIG. 2, thus generating a control pulse at control port 6. The instrumentation package is capable of providing suitable coded signals to the actuator which are indicitive of various physical conditions in the bore hole. These signals, converted to suitable pressure control pulses by the actuator of FIGS. 4A and 4B, may be applied to control the pulser of the invention. Thus, information provided by the instrumentation package can be transmitted by the pulse mechanism to the receiver assembly above ground level. The pulsing system disclosed is an improved highly efficient system that is capable of transmitting pulses at extremely rapid rates, and therefore is capable of transmitting greater quantities of data in a given time period than previously known mechanical pulsing systems. Further, the device has no moving parts to jam or wear out or mechanical seals to cause leaks. The device is very inexpensive to fabricate and maintain, and can be easily adapted for use with standard well logging instrumentation, as it can be easily installed in conventional drill collars.

In situations where well depth exceeds about 15,000 feet where drilling mud properties severely attenuate transmitted mud pulse signals, the decay in the intensity of the mud pulse signal makes it extremely difficult to use signals for transmitting data from the bottom of the bore hole. In such a situation, the desirability of a device capable of boosting the power of the mud pulse signal is evident. The system of the invention comprises such a device as illustrated in FIG. 5.

Figure 5:
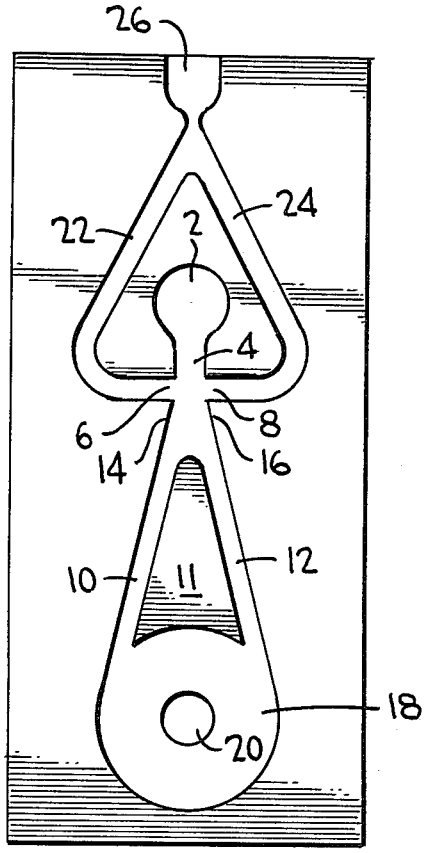
FIG. 5 illustrates a pulsing device suitable for use as a booster, or relay pulser in the present system.

The device of FIG. 5 is essentially a pulser, as previously described with reference to FIG. 2, having a modified control means. These booster, or relay pulsers, could be installed at intervals of perhaps 5,000–10,000 feet while running the drill string. The devices would require no external power or other connections, and would derive their power from the motion of the drilling fluids.

The signal booster comprises a bistable fluid amplifier and vortex chamber, as previously described in respect to FIG. 2, like elements denoted by the same reference numerals. At least a portion of the fluid mud circulating in the drill string is directed into intake 2 by suitable intake means, to provide the power flow through nozzle 4. The control ports 6 and 8 are connected by means of a control loop 22,24, which comprises control inlet 26. The control input 26 is oriented in the drill string to receive pressure pulses generated by the pulsing device located adjacent to the instrumentation package.

Figure 6A:
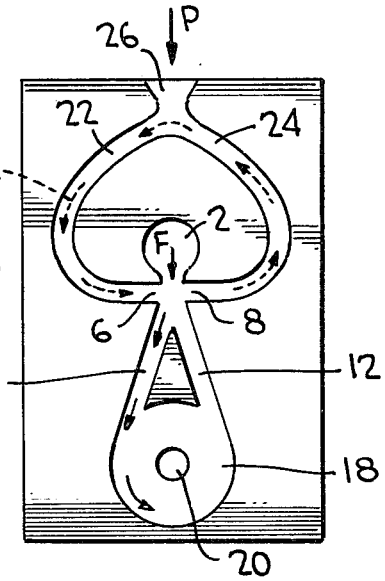
FIGS. 6A, 6B, and 6C illustrate the manner in which the booster or relay pulser operates to generate pulses in the mud flow.
Figure 6B:
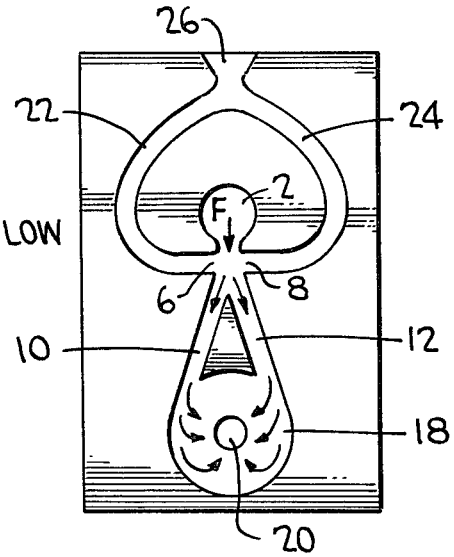
Figure 6C:
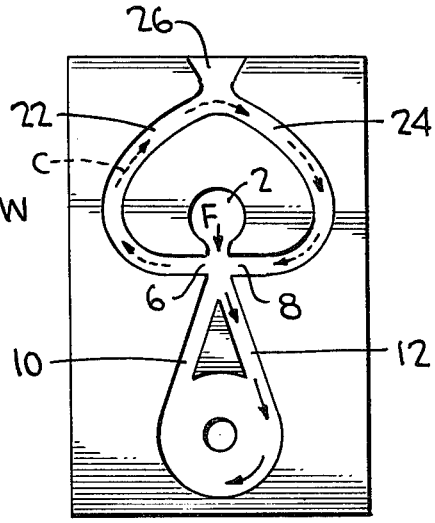

FIGS. 6A–6C illustrate the manner in which the signal booster operates. Power flow F, as illustrated in FIG. 6A, enters inlet 2 and assumes a stable flow condition through outlet 10, in the manner described above with reference to FIG. 2. The fluid flow through outlet 10 generates a region of low pressure in the vicinity of control port 6, and the region of higher pressure in the vicinity of control port 8. This pressure differential generates a flow through the control feedback loop 22–24 in a counterclockwise direction, as indicated by dotted arrows C in FIG. 6A. When a pressure pulse is received from the pulsing device located at the lower end of the bore hole, as indicated by arrow P in FIG. 6A, the pulse will enter control port 26. This pressure pulse will follow the path of least resistance into the control feedback loop, and thus will be diverted toward lower pressure zone 22. The pressure pulse will travel through the feedback control toward control port 6 thus generating a positive pressure pulse at the control port 6. This pulse will operate to deflect the fluid flow from output 10 toward outlet 12, as shown in FIG. 6B. Upon the establishment of a stable flow condition through outlet 12, the flow feedback control loop will assume a clockwise direction as shown in FIG. 6C. It can be seen that a subsequent pulse at control inlet 26 will operate to deflect fluid flow back toward outlet 10.

The pulses received from the pulsing device located near the bottom of the bore hole will propagate through the drill string to the location of the booster device. These pulses will then be used as control signals, as illustrated in FIGS. 6A–6C to control the flow of fluid through the amplifier of the booster device to the vortex of the booster device. The amplifier of the booster device operates to continually reverse the vortex in the chamber 18, in the same manner as described with respect to the device of FIG. 2, to generate pulses in the fluid flow entering inlet 2 of the booster device. Thus the incoming pulse P is amplified and relayed through the drill string toward the receiver, as shown in FIG. 1. Any number of relay devices, or booster devices may be provided in the drill string depending upon the length of the drill string and the need for amplification of the pressure pulses. The signal amplification device of the present invention makes it possible to use fluid pulse telemetry to transmit information signals over greater distances than was heretofore possible. When used in conjunction with conventional drilling equipment, the device makes it possible to monitor bore holes at much greater depths than was previously possible.

While the signal boosting device has been disclosed as used in conjunction with the pulsing device of FIG. 2 of the disclosure, it is not essential that it be so used. It is possible that the device of FIG. 5 can be used in conjunction with any conventional mud pulsing device known in the art. For example, the signal boosting device of FIG. 5 could be used in conjunction with a conventional mechanical pulser comprising a valve mechanism, as shown in U.S. Pat. No. 3,958,217, to boost the pulses produced by the valve mechanism disclosed in that patent.

Having disclosed and described the preferred embodiments of the invention, I wish it to be understood that I do not desire to be limited to the exact details of construction shown and described, for obvious modifications can be made by a person skilled in the art.

We claim:

1. A device for producing pulses in a fluid body comprising, bi-stable fluid amplifier means for establishing a stable flow of fluid through one outlet thereof, said bi-stable amplifier having dual outlets, vortex chamber means hving inlets on the periphery thereof and at least one outlet at the center thereof, said outlets of said bi-stable amplifier means entering said vortex chamber tangentially in opposite directions through said inlets on the periphery thereof, and control means associated with said bi-stable amplifier means for selectively diverting the stable flow in one outlet thereof and for establishing stable flow through the other of said dual outlets, whereby fluid flow through said amplifier means and said vortex chamber means is restricted to a first degree during diversion of the stable fluid flow, and to a second greater degree when the stable flow passes through only one of said outlets, thereby producing pulses in said fluid each time said flow is diverted.

2. A device as in claim 1, wherein said bi-stable fluid amplifier means comprises an inlet and a nozzle providing said flow, and said control means comprises a control port on either side of said nozzle for admitting control fluid to the amplifier.

3. A device as in claim 2, further comprising a control loop in fluid communication with each of said control ports for providing control fluid to said ports.

4. A device as in claim 3 further comprising electromechanical means associated with said control loop for generating pulses in fluid in said control loop.

5. A device as in claim 4 wherein said electromechanical means comprises an electrically actuated solenoid means in said loop and fluidically coupled to each of said control ports, and means responsive to actuation of said solenoid for generating a pulse in said control loop.

6. A device as in claim 5 comprising diaphragm means associated with said solenoid means and in contact with fluid in said loop, said diaphragm means producing pulses in the fluid in said loop in response to movement of said solenoid means.

7. A device as in claim 3 further comprising a fluid inlet to said control loop for receiving pulses in said fluid body and directing said pulses to a selected one of said control ports.

8. A device as in claim 1 or 5, in combination with a drill string having fluid flowing therethrough, additionally comprising sensing means associated with said drill string and responsive to physical conditions encountered by said drill string, said sensing means comprising means for generating signals in response to said physical conditions, wherein said device for producing pulses in said body of fluid produces such pulses in the fluid flowing through said drill string in response to said signals.

* * * * *